US006431904B1

(12) United States Patent
Berelsman

(10) Patent No.: US 6,431,904 B1
(45) Date of Patent: Aug. 13, 2002

(54) CABLE ASSEMBLY WITH MOLDED STRESS RELIEF AND METHOD FOR MAKING THE SAME

(75) Inventor: Timothy N. Berelsman, Delphos, OH (US)

(73) Assignee: Krone, Inc., Englewood, CO (US)

( * ) Notice: Subject to any disclaimer, the term of this patent is extended or adjusted under 35 U.S.C. 154(b) by 0 days.

(21) Appl. No.: 09/578,765

(22) Filed: May 25, 2000

Related U.S. Application Data

(60) Provisional application No. 60/136,555, filed on May 28, 1999.

(51) Int. Cl.[7] ..... H01R 13/56; H01R 24/00; H01R 4/50; H01R 13/625

(52) U.S. Cl. ..... 439/447; 439/676; 439/344

(58) Field of Search ..... 439/395, 491, 439/447, 676, 344, 901

(56) References Cited

U.S. PATENT DOCUMENTS

| | | | | |
|---|---|---|---|---|
| 4,634,208 A | | 1/1987 | Hall et al. | |
| 4,647,135 A | * | 3/1987 | Reinhardt | 439/460 |
| 4,824,394 A | | 4/1989 | Roath et al. | 439/395 |
| 5,183,966 A | | 2/1993 | Hurtado et al. | 474/20 |
| 5,244,409 A | | 9/1993 | Guss, III et al. | 439/490 |
| 5,334,044 A | * | 8/1994 | Falossi et al. | 439/491 |
| 5,386,344 A | | 1/1995 | Beaman et al. | 361/785 |
| 5,433,631 A | | 7/1995 | Beaman et al. | 439/493 |
| 5,556,307 A | | 9/1996 | Johnston | 439/676 |
| 5,759,069 A | * | 6/1998 | Kitatani et al. | 439/675 |
| 5,899,770 A | * | 5/1999 | Ezawa | 439/418 |
| 5,954,542 A | * | 9/1999 | Wu et al. | 439/610 |
| 6,193,542 B1 | * | 2/2001 | Marowsky et al. | 439/418 |
| 6,250,951 B1 | * | 6/2001 | Milner et al. | 174/27 |
| 6,328,601 B1 | * | 12/2001 | Yip et al. | 439/608 |

* cited by examiner

*Primary Examiner*—Brian Sircus
*Assistant Examiner*—Chaudrika Prasad
(74) *Attorney, Agent, or Firm*—Rader, Fishman & Grauer PLLC

(57) ABSTRACT

The invention is comprised of a cable assembly having a cable, a modular plug, and a molded stress relief body. The cable includes at least one twisted wire pair of a given length and at least one outer jacket that surrounds a portion of the length of the twisted wire pair, wherein each individual wire of the twisted wire pair is comprised of a conductor wire and an outer insulator. The modular plug includes an uppermost surface and a receiving cavity to establish an electrical connection with the cable. A molded stress relief body is used to cover at least a portion of the cable and the modular plug. To reduce the amount of stress and strain encountered by and between the modular plug and the cable, the molded stress relief body is molded about, or bonded to, at least a portion of the twisted wire pair that is not surrounded by the outer jacket of the cable. Hence, the molded stress relief body provides a connection between the cable and modular plug and is firmly attached to the twisted pair so as to effectively secure or "freeze" the twisted wire pair, or pair, in place.

27 Claims, 4 Drawing Sheets

CABLE ASSEMBLY WITH MOLDED STRESS RELIEF AND METHOD FOR MAKING THE SAME

This application claims priority from co-pending U.S. Provisional Application Ser. No. 60/136,555 entitled Cable Assembly With Molded Stress Relief And Method For Making The Same filed on May 28, 1999.

FIELD OF THE INVENTION

This invention relates to a cabling assembly for improved data transmission, and more particularly to a cable assembly with molded strain relief that is suitable for use in high-speed data communication applications and a method for making the same.

BACKGROUND OF THE INVENTION

The purpose of network and telecommunication cables is to carry data or signals from one device to another. As telecommunication and related electronic networks and systems advance to meet the ever-increasing needs of the modem world, it has become increasingly important to improve the speed, quality and integrity of the data or signals being transmitted. This is particularly important for higher-speed applications, where resulting losses and distortions can be magnified.

One method of transmitting data and other signals is by using an individually twisted pair of electrical wires, where each wire has been coated with a plastic or thermoset insulating material. After the wires have been twisted together into cable pairs, various methods known in the art may be employed to arrange and configure the twisted wire pairs into high-performance transmission cable arrangements. Once twisted pairs are configured into a "core," a plastic or thermoset material jacket is typically extruded over the twisted wire pairs to maintain the configuration and to function as a protective layer. When more than one twisted pair group is bundled together, the combination is referred to as a multi-pair cable. Such multi-pair twisted cabling is commonly utilized in connection with local area network (LAN) applications.

In the past, patch cord cable assemblies for data networking systems, such as those used in company LANs, have been considered to be low cost, somewhat dispensable items. Recently, as required transmission speeds have increased, it has been found that the patch cord cable assemblies can drastically impact the data throughput of the systems. Practice has shown that a significant portion of the data or signal loss and/or distortion occurs at the areas with the highest stress, due to flexing, tension or torsional twisting, on the cable. A common problem is found in LANs where a four-pair cable connects to and exits a modular plug, the critical area being where the pairs are altered for termination and connection purposes. To address some of the associated problems, the network industry has adopted certain conventions and standards. For instance, to comply with ANSI/TIA/EIA 568A-1,a minimum bend radius of 25.4 mm (1.0 in.), or about four times the overall cable diameter, should be maintained.

Moreover, when in service, flexible cables are often routed in a variety of paths. The associated flexing, twisting, bending, and pulling of the cable is consequently transferred to the wires or wire pairs contained therein. Such stresses can lead to misalignment of the wires and can create a number of commonly recognized data transmission signal losses and distortions, such as delay skew.

One method to minimize the stress associated with such twisted pair cabling connections is to incorporate some form of stress relief into the cable assembly. However, traditional stress relief members, often act only as a cover or protective plate and do not function as a solid unit with the cable, hence, an unacceptable level of stress can still be imparted on the assembly. Therefore, a need exists for improved high-end cabling that can be adapted to a number of geometric configurations; can be readily implemented and installed; and can eliminate or minimize losses and distortion associated with the stresses directed upon the cable assembly.

SUMMARY OF THE INVENTION

Accordingly, it is a primary object of the present invention to provide an improved cable assembly that overcomes the shortcomings and limitations associated with prior paired electrical wires and cabling techniques.

It is another object of the present invention to provide a cable assembly with improved structural characteristics, particularly in the connection between a modular plug and associated data transmission cable so as to minimize data losses and distortion.

It is still another object of the present invention to provide a cable assembly that reduces the amount of stress between a modular plug and an associated data transmission cable having one or more twisted ware pairs.

It is a further object of the present invention to provide a high-end cable assembly suitable for use in high-speed data transmission applications with improved electrical and mechanical properties when compared to similar assemblies that employ conventional techniques.

It is yet a further object of the present invention to provide a cable assembly that reduces the amount of time associated with the manufacturer's assembly and subsequent installation.

It is still a further object of the present invention to provide an improved cable assembly that can be easily adapted to function with cables having a variety of geometric cross sectional configurations.

Other and further objects, advantages and novel features of the invention will become apparent from the following detailed description, taken in connection with the accompanying drawings, wherein, by way of illustration and example, several embodiments of the present invention are disclosed.

To achieve the foregoing and other objects, and in accordance with one aspect of the present invention, a cable assembly is disclosed which includes a cable, a modular plug, and a molded stress relief body. The cable includes at least one twisted wire pair of a given length and at least one outer jacket that surrounds a portion of the length of the twisted wire pair, wherein each individual wire of the twisted wire pair is comprised of a conductor wire and an outer insulator. The modular plug includes an uppermost surface and a receiving cavity to establish an electrical connection with the cable. A molded stress relief body is used to cover at least a portion of the cable and the modular plug. To reduce the amount of stress and strain encountered by and between the modular plug and the cable, the molded stress relief body is molded about, or bonded to, at least a portion of the twisted wire pair that is not surrounded by the outer jacket of the cable. Hence, the molded stress relief body provides a connection between the cable and modular plug and is firmly attached to the twisted pair so as to effectively "freeze" the twisted wire pair, or pairs, in place to improve the connection and durability of the assembly.

BRIEF DESCRIPTION OF THE DRAWINGS

The present invention will be more readily understandable from consideration of the accompanying drawings, wherein.

DETAILED DESCRIPTION OF PREFERRED EMBODIMENTS

Figure 1:
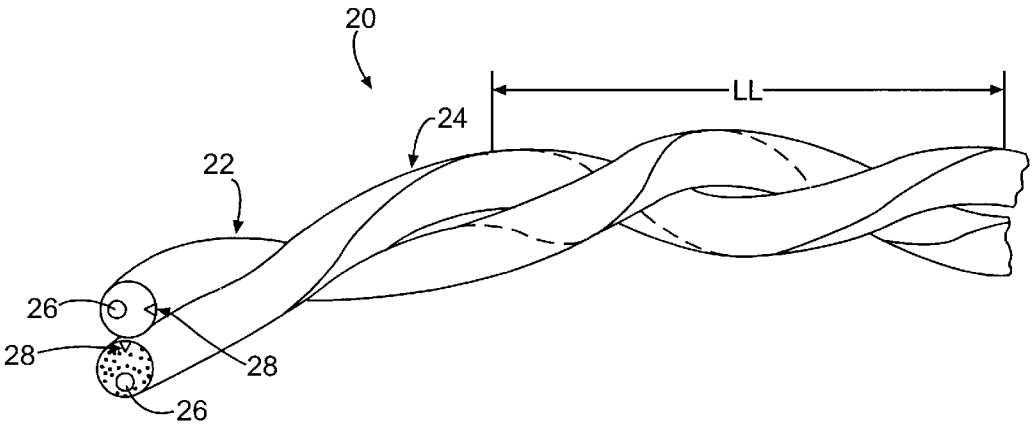
Fig. 1 (Prior Art)
FIG. 1 is a perspective view of a segment of two pre-twisted insulated wires combining to form a twisted wire pair.

As shown in FIG. 1, a conventional twisted wire pair 20 includes a pair of individual wires, designated 22 and 24, respectively. Each individual wire is comprised of at least a conductor 26 and an outer insulator 28. The conductor 26 is formed from a conventional conductive material capable of effectively and efficiently transmitting electronic data and signals. While the conductor 26 can be formed from a number of materials, it is typically comprised of a metal having good conductive properties, such as copper. In accordance with the present invention, the outer insulator 28 is comprised of a plastic or thermosettable material, preferably flexible polyvinyl chloride (PVC) a thermoplastic elastomer (TPE), silicone or a plastic having similar chemical and physical properties.

The first and second insulated wires 22 and 24 are twisted around one another in a conventional manner so as to form a twisted wire pair 20. In applications involving high performance data transmission, the cables will usually contain a plurality of twisted wire pairs. For example, "category 5"wiring of the type commonly used for Local Area Networks (LANs) is usually comprised of at least four twisted wire pairs.

Figure 2:
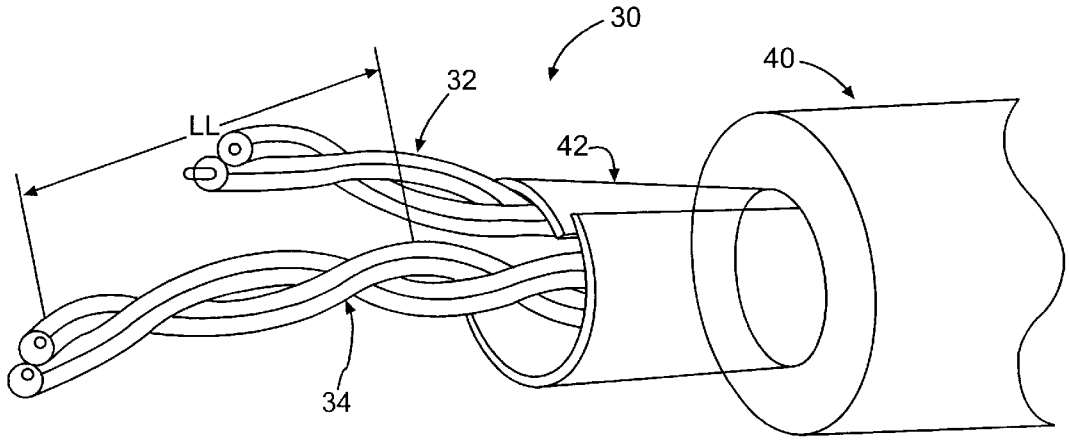
Fig. 2 (Prior Art)
FIG. 2 is a perspective view of the end portion of one type of cable that can be used in connection with the present invention.

As shown in FIGS. 1 and 2, the individual wires 22 and 24 of the twisted pairs are "lay twisted" by a 360-degree revolution about a common axis along a predetermined length, referred to as a twist length or lay length. The dimension labeled LL represents one twist length or lay length.

FIG. 2 is illustrative of a cable 30 (in this instance a "multi-pair" cable) that includes two twisted wire pairs, 32 and 34; an outer jacket 40; and further depicts an optional shield 42. The outer jacket 40 is comprised of a plastic or thermoset material, such as PVC, silicone or TPE, and surrounds the twisted wire pairs 32 and 34. The jacket 40 is preferably formed in a continuous extrusion process, but can be formed by using other conventional processes. If desired for certain environments or applications, an optional shield 42, such as one comprised of foil, can be wrapped around the twisted wires, either individually or collectively, to provide an added measure of protection for the wire and the data or signal transmission.

Figure 3:
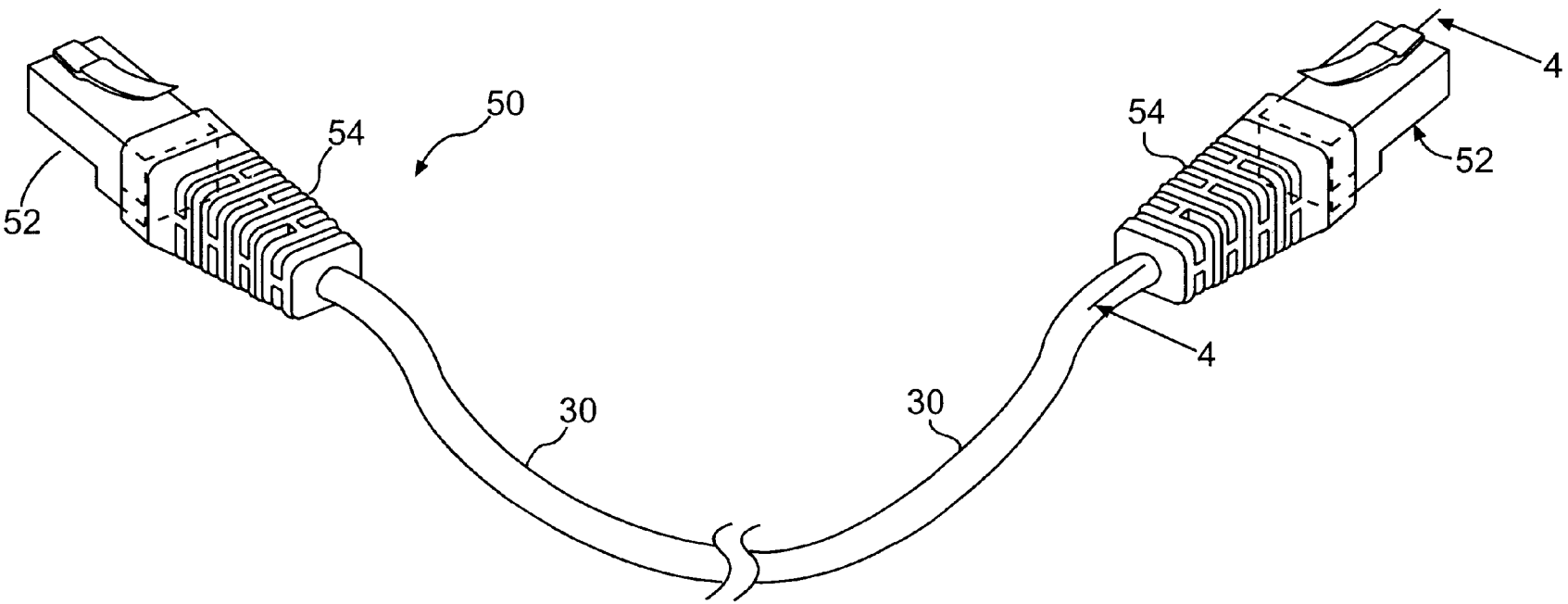
FIG. 3 is a perspective view of an embodiment of a cable assembly constructed in accordance with the principles of the present invention.
Figure 4:
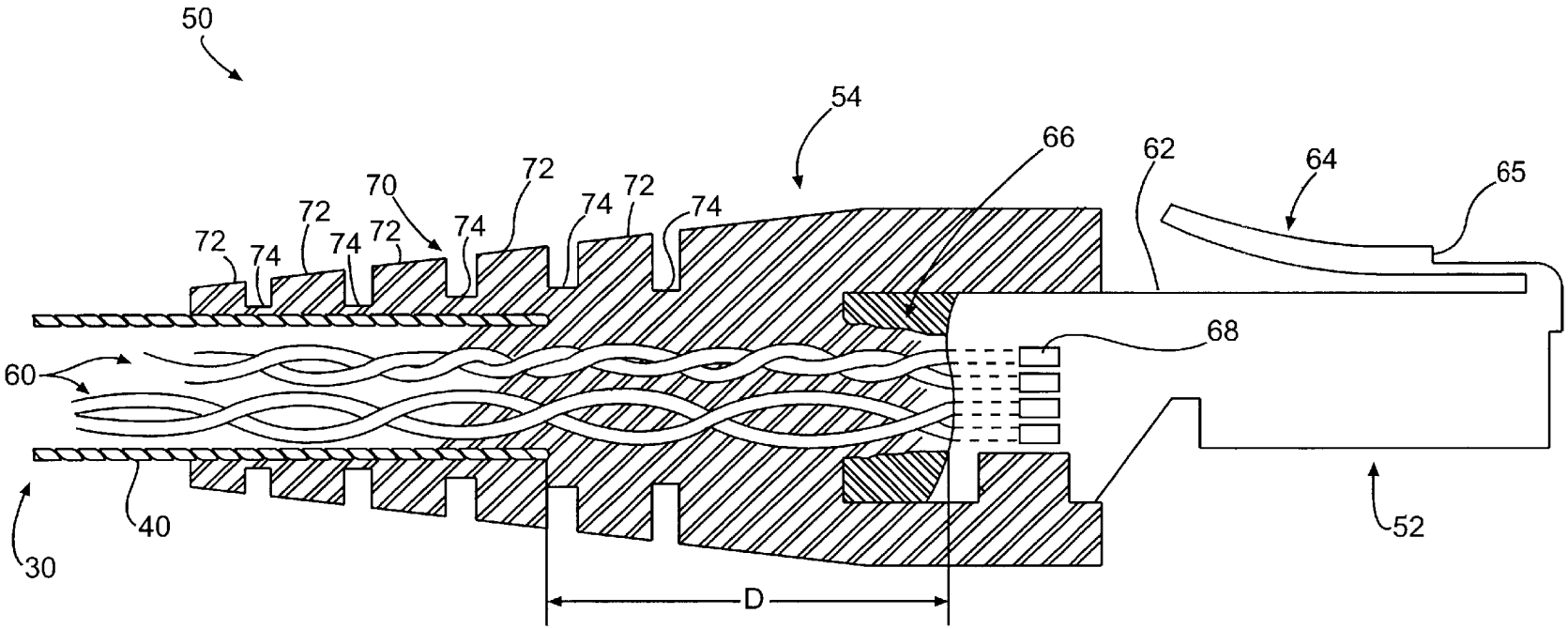
FIG. 4 is a cross-sectional view of a portion of the cable assembly of FIG. 3 shown taken in the direction of lines 4—4.

Referring next to FIG. 3, a perspective view of one particular embodiment of a cable assembly 50 of the present invention is shown. FIG. 4 is a cross-sectional view of a portion of the cable assembly of FIG. 3 taken in the direction of lines 4—4. As illustrated by the embodiment depicted in FIGS. 3 and 4, the cable assembly 50 includes a cable 30, a modular plug 52, and a molded stress relief body 54. Preferably, the cable 30 is a multi-pair cable having a plurality of twisted wire pairs, generally depicted as 60, and an outer jacket 40. The cable generally has a circular, semi-round, flat, or concave configuration when viewed in cross section and the length of the cable 30 will vary depending upon the application and applicable industry standards. The jacket is comprised of a plastic or thermoset material, such as polyvinyl chloride (PVC), silicone or a thermoplastic elastomer (TPE). In certain applications, an optional shield (such as the one shown in FIG. 2) may be included between the individual or collective twisted wire pairs and the outer jacket 40.

The outer jacket 40 surrounds and covers a significant portion of the length of the twisted wire pairs 60, but does not cover the entire length of the twisted wired pairs. Attention is drawn to the fact that a certain length of the twisted wire pairs 60 extends beyond the corresponding end of the outer jacket 40. The length of "exposed," or uncovered twisted wire pairs 60 between the connection to the modular plug 52 and the end of the twisted wire pairs 60 covered by an outer jacket 40 is defined to be the "minimum defined distance" from the modular plug 52 and is designated as D. Within the minimum defined distance, the wires of the twisted pairs 60 are typically separated and positioned to facilitate attachment to the modular plug. Securing, or "freezing," the uncovered twisted wire pairs 60 in this manner serves to encapsulate the wires and better individually secure or fix them in their intended positions so as to generally function as an integral unit in accommodating various application stresses. For instance, the techniques of this invention allow the wires to be straightened and laid parallel to one another as they enter the receiving cavity 66 of the plug 52 and then be held firmly in place. As a result of this technique, there is a reduced tendency for the stress on the cable 30 near the interface with the modular plug 52 from being translated back through the remainder of the cable 30, thereby causing further data transmission problems, such as signal return loss.

The modular plug 52 may be of any conventional type commonly used for data transmission applications, for example, a modular plug intended for use in connection with Local Area Networks, or LANs. Some of the more common types of modular plugs include the 66 or 110 Block plug, the BIX plug, UTP ALL-LAN plug, High Band Module plug, and other plugs designed to terminate communication cables through Insulation Displacement Contact (IDC) terminations.

The modular plug 52 is made of a plastic or thermoset material and includes an upper main body surface 62, a detent 64, a receiving cavity 66, and connectors 68. The individual wires of the twisted wire pairs 60 are conventionally attached to the connectors (or contacts) 68 of modular plug 52 located in the receiving cavity 66 so as to establish an appropriate electrical connection for data transmission. To facilitate such a connection, the portion of the twisted wires 60 which is in contact with the connectors 68 will not be covered by the outer jacket 40.

As further illustrated in FIG. 3, a molded stress relief body 54 covers a portion of both the modular plug 52 and the cable 30. The molded stress relief body 54 is comprised of a plastic or thermoset material that is compatible for molding with and/or bonding to the plastic or thermoset material of the outer insulator 28 of the twisted wire pairs 20. In most instances, the molded stress relief body will also be compatible for molding and/or bonding with the plastic or thermoset outer jacket 40. To provide a strong molded connection or bond between the molded stress relief body 54 and the twisted wire pairs 60 and, where applicable, the plastic or thermoset outer jacket, the plastic or thermoset material of each component in contact with one another will preferably be the same or a plastic or thermoset material which is chemically and mechanically compatible. For example, the molded stress relief body 54 and the outer jacket 40 could be comprised of any of the four following possible combinations, of which combinations 1 and 4 are preferred:

| Combination | Molded Stress Relief Body | Outer Jacket and/or Outer Insulator of Twisted Pairs |
|---|---|---|
| 1 | PVC | PVC |
| 2 | PVC | TPE |
| 3 | TPE | PVC |
| 4 | TPE | TPE |

The stress relief body 54 is molded over the exposed twisted wire pairs 60 and a portion of the outer jacket of the cable. Preferably, the stress relief body is injection molded over the cable. This can be accomplished by a number of conventional molding techniques, including insert molding and overflow molding. Insert molding usually has special cavity configurations that can be used to hold the contacts in place as the plastic or thermoset material of the strain relief body 54 is molded about the twisted wire pairs 20 of the cable 30. Overflow molding is a technique whereby the plastic or thermoset molding material is molded over the cable to form the stress relief body 54. The material flow may be provided from an injection apparatus via a conventional runner and gate flow system in the mold as is well known in the art. However, it is important to note that other conventional forms of molding plastic or thermoset material, such as compression molding, can be used and are within the scope and spirit of this inventive concept.

Alternately, the molded stress relief body 54 can be formed apart from the cable 30 and then subsequently secured to a portion of the twisted wire pairs 60 by any number of conventional processing techniques—provided a secure attachment is formed and the twisted wire pairs 60 are properly held in place. Examples of alternative processing methods that can be used to bond the molded stress relief body 54 to the twisted wire pairs 60 and the outer jacket 40 of the cable 30 include adhesive bonding, electromagnetic bonding, induction heating, induction bonding, radio frequency sealing and ultrasonic welding.

The molded stress relief body 54 covers a portion of the modular plug 52. However, for most applications, it is important that the molded stress relief body 54 does not interfere with the functioning of the detent 64. As such, in the preferred embodiment, the molded stress relief body should not extend past the ridge, or nub 65 located on the detent 64 so as to cause a connection problem between the modular plug and other components (not shown). Where the plastic or thermoset material from which the molded stress relief body is flexible in nature, the portion of the detent 64 which does not enter or engage a receptacle (not shown) can be surrounded by the plastic or thermoset material of the molded stress relief body 54 without interfering with the proper functioning of the detent 64. Because the detent 64 is a weak element that is known to break in practice, covering and/or surrounding the detent in such a manner can further serve to protect the detent.

Moreover, the molded stress relief body 54 may be formed in a number of different shapes and configurations. In the preferred construction, the molded stress relief body 54 will have a substantial tapered portion 70. Preferably, tapered portion 70 has a minimum length equal to three times the outer diameter of the cable, and more preferably, about four times the cable outer diameter. Therefore, if the cable outer diameter is 0.250", then the most preferred taper length is between 0.75 and 1.0 inches. The increased length of tapered portion 70 helps to prevent the cable 30 from flexing from side to side and distorting the layout of the configuration, while also serving to prevent individual wires from being pulled out of the modular plug 52. It is further preferred that the tapered portion 70 is at least partially corrugated in a conventional manner. The alternating ridges 72 and valleys 74 of the corrugated design help dissipate stresses associated with the bending and flexing of the cable 30.

When deemed necessary or desirable, a conventional central stabilizer (not shown) can be incorporated into the cable 30 as a filler or brace to help retain the cable to a specific geometric configuration. For example, when it is intended to maintain a circular cross sectional cable configuration, a central star "+" stabilizer may be used to help retain the intended shape.

A noteworthy advantage of the instant invention is that cables having a wide number of cross sectional geometric configurations can also be stress relieved in accordance with the principles of the invention. When non-traditional geometric cable configurations are involved, the cable can remain intact up to the point where the pairs are laid parallel for connection to the modular plug 52. The molded stress relief body 54 then acts to secure the pairs prior to their entry into the plug 52 thereby reducing the physical/mechanical stresses on the cable 30.

In carrying out the present invention, the minimum defined distance D of the twisted wire pairs 60 should be at least 90% of the longest lay length of the individual twisted wire pairs 60. More preferably, the minimum defined distance D will be equal to or greater than the longest lay length of the individual twisted wire pairs 60. When category 5 cable is involved, in order to comply with industry standards, the minimum defined distance D will generally be at least about 25.4 mm (1.0 in.) to provide the desired amount of stress relief.

Figure 5:
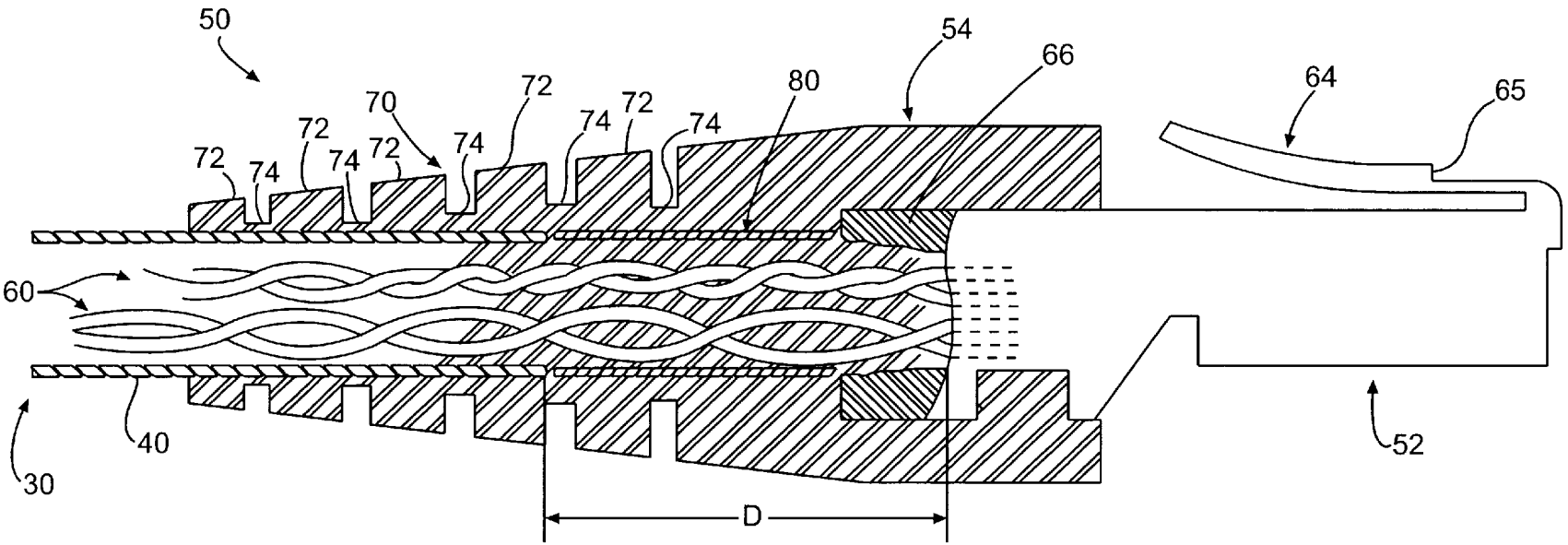
FIG. 5 is a cross-sectional view of an alternate embodiment of the cable assembly of FIG. 3 shown taken in the direction of lines 4—4.

In keeping with the principles of the present invention, an alternate embodiment of the cable assembly 50 is depicted in FIG. 5. The cable 30, as shown in a cross-sectional view, includes a dielectric 80 that surrounds the twisted pairs 60 positioned between the end of the outer jacket 40 and the modular plug 52. Generally, the object of including the additional dielectric 80 is to maintain the overall dielectric effect along the length of the wire at a constant value, with the preferred dielectric constant being about 2.1. The dielectric or insulative material may be of any commercially available dielectric material, such as polyvinyl chloride (PVC), polyethylene (PE), polypropylene (PP), or fluorocopolymers (like Teflon®) and polyolefin. The dielectric or insulative material may also be fire resistant as necessary. However, when a dielectric 80 is utilized, it is preferred that the dielectric 80 be comprised of a material that can be molded or bonded to the molded stress relief body 54.

It is further contemplated that the principles of this invention can be used to provide a cable with improved installation or assembly features in which the wires of the cable can be pre-configured and secured in place to facilitate more efficient connection to specific types of devices such as modular plugs. More specifically, this may be accomplished by providing a cable of the type previously disclosed, configuring the "exposed" wires of a twisted wire pair for connection to a given device, securing or "freezing" at least one lay length of each twisted wire pair by a molded stress relief body, and subsequently attaching the pre-configured wires of the cable to said device.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications will come within the teachings of this invention and that such modifications are within its spirit and the scope as defined by the claims.

What is claimed is:

1. A cable assembly suitable for high-speed data transmission, comprising:

a cable comprising at least one twisted wire pair having a length, each wire of the twisted wire pair is comprised of a conductor and an outer insulator, and an outer jacket covering a portion of the length of the twisted wire pair, a portion of the length of the twisted wire pair not covered by the outer jacket defining an exposed portion, the exposed portion having a length of at least equal to a lay length of the twisted wire pair;

a dielectric material covering at least a portion of the exposed portion of the cable;

a modular plug including an upper main body surface, a receiving cavity, and connectors for establishing an electrical connection with the cable; and a molded stress relief body molded about a length of cable positioned adjacent the modular plug, the length of the molding being at least equal to the longest lay length of the twisted wire pair, wherein the stress relief body covers at least a portion of the cable and modular plug, and wherein the molded stress relief body is molded about a portion of the outer insulator of the twisted wire pair to form an integral structure therewith, thereby minimizing data transmission signal losses and distortions within the cable.

2. The cable assembly according ot claim 1, wherein the dielectric material is selected from the group consisting of polyvinyl chloride (PVC), thermpolyethylene (PE), polypropylene (PP), fluoro-copolymers, and polyolefins.

3. The cable assembly according to claim 1, wherein the modular plug includes a detent that extends outwardly from the uppermost surface of the modular plug in the direction of the receiving cavity of the modular plug.

4. The cable assembly according to claim 3, wherein the detent can be manually manipulated.

5. The cable assembly according to claim 4, wherein the molded stress relief body is substantially adjacent to the detent and covers at least a portion of the detent.

6. The cable assembly according to claim 1, wherein the molded stress relief body extends within the receiving cavity of the modular plug.

7. The cable assembly according to claim 1, wherein the molded stress relief body includes a tapered portion that tapers inwardly toward the cable in the direction moving away from the modular plug.

8. The cable assembly according to claim 7, wherein the tapered portion has a length equal to between about three and four times a cable diameter.

9. The cable assembly according to claim 8, wherein the tapered portion length is between about 0.75 and 1.0 inches.

10. The cable assembly according to claim 7, wherein the tapered portion is corrugated.

11. A cable assembly suitable for high-speed data transmission, comprising:

a cable comprising at least one twisted wire pair having a length, each wire of the twisted wire pair is comprised of a conductor and an outer insulator, and an outer jacket covering a portion of the length of the twisted wire pair, a portion of the length of the twisted wire pair not covered by the outer jacket defining an exposed portion, the exposed portion having a minimum defined distance of at least 90% of a lay length of the twisted wire pair;

a dielectric material covering at least a portion of the exposed portion of the cable;

a modular plug including an upper main body surface, a receiving cavity, and connectors for establishing an electrical connection with the cable; and a molded stress relief body molded about a length of cable positioned adjacent the modular plug, the length of the molding being at least equal to the longest lay length of the twisted wire pair, wherein the stress relief body covers at least a portion of the cable and modular plug, and wherein the molded stress relief body is molded about a portion of the outer insulator of the twisted wire pair to form an integral structure therewith, thereby minimizing data transmission signal losses and distortions within the cable.

12. The cable of claim 11, wherein the exposed portion has a minimum defined distance of at least equal to the lay length of the twisted wire pair.

13. The cable assembly according to claim 11, wherein the dielectric material is selected from the group consisting of polyvinyl chloride (PVC), thermpolyethylene (PE), polypropylene (PP), fluoro-copolymers, and polyolefins.

14. The cable assembly according to claim 11, wherein the modular plug includes a detent that extends outwardly from the uppermost surface of the modular plug in the direction of the receiving cavity of the modular plug.

15. The cable assembly according to claim 14, wherein the detent can be manually manipulated.

16. The cable assembly according to claim 15, wherein the molded stress relief body is substantially adjacent to the detent and covers at least a portion of the detent.

17. The cable assembly according to claim 11, wherein the molded stress relief body extends within the receiving cavity of the modular plug.

18. The cable assembly according to claim 11, wherein the molded stress relief body includes a tapered portion that tapers inwardly toward the cable in the direction moving away from the modular plug.

19. The cable assembly according to claim 18, wherein the tapered portion has a length equal to between about three and four times a cable diameter.

20. The cable assembly according to claim 19, wherein the tapered portion length is between about 0.75 and 1.0 inches.

21. The cable assembly according to claim 18, wherein the tapered portion is corrugated.

22. A method for making a cable assembly with a molded stress relief body that is suitable for high-speed transmission, the cable assembly including (i) a cable having at least one twisted wire pair of a given lay length having at least one conductor, a corresponding outer insulator, and an outer jacket, and (ii) a modular plug having respective connectors for connecting the at least one conductor of the twisted wire pair with the modular plug, the method comprising:

exposing a portion of the twisted wire pair, the exposed portion having a length of at least equal to the lay length of the twisted wire pair;

covering at least a portion of the exposed portion of the cable with a dielectric material;

establishing an electrical connection with the cable assembly; and molding a stress relief body about the exposed portion of the twisted wire pair so as to form a partially integral structure therewith, thereby minimizing data transmission signal losses and distortions within the cable.

23. The method of claim 22, wherein the dielectric material is comprised of a material capable of being bonded or molded to the stress relief body.

24. The method of claim 23, wherein the dielectric material is selected from the group consisting of polyvinyl chloride (PVC), thermpolyethylene (PE), polypropylene (PP), fluoro-copolymers, and polyolefins.

25. A method for making a cable that is suitable for high-speed data transmission, the method comprising:

providing a cable having at least one twisted wire pair having a lay length, each wire of the twisted wire pair includes at least one conductor and a corresponding outer insulator;

covering a portion of the length of the at least one twisted wire pair with an outer jacket, a portion of the length of the at least one twisted wire pair not covered by the outer jacket defining an exposed portion, the exposed portion having a length of at least equal to the lay length of the at least one twisted wire pair;

covering at least a portion of the exposed portion of the cable with a dielectric material;

configuring the individual wires of the at least one twisted wire pair for attachment to a modular plug; and providing a molded stress relief body, wherein the molded stress relief body encapsulates the exposed portion of the at least one wire pair and secures the exposed portion of the at least one wire pair in the configured position, thereby minimizing data transmission signal losses and distortions within the cable.

26. The method of claim 25, wherein the dielectric material is comprised of a material capable of being bonded or molded to the stress relief body.

27. The method of claim 26, wherein the dielectric material is selected from the group consisting of polyvinyl chloride (PVC), thermpolyethylene (PE), polypropylene (PP), fluoro-copolymers, and polyolefins.

* * * * *

UNITED STATES PATENT AND TRADEMARK OFFICE

CERTIFICATE OF CORRECTION

PATENT NO. : 6,431,904 B1
DATED : August 13, 2002
INVENTOR(S) : Timothy N. Berelsman It is certified that error appears in the above-identified patent and that said Letters Patent is hereby corrected as shown below:

Column 7,
Line 48, replace “according ot claim 1” with -- according to claim 1 --.

Signed and Sealed this

Tenth Day of December, 2002

JAMES E. ROGAN
*Director of the United States Patent and Trademark Office*